US010894262B1

(12) United States Patent
Cooper

(10) Patent No.: US 10,894,262 B1
(45) Date of Patent: Jan. 19, 2021

(54) ELECTROSTATIC FLUID SPRAYER WITH ACTIVE FLUID CLOUD DISPERSAL FEATURE AND METHOD OF ELECTROSTATIC SPRAYING

(71) Applicant: Steven C. Cooper, Athens, GA (US)

(72) Inventor: Steven C. Cooper, Athens, GA (US)

(73) Assignee: ES PRODUCT DEVELOPMENT, LLC, Athens, GA (US)

( * ) Notice: Subject to any disclaimer, the term of this patent is extended or adjusted under 35 U.S.C. 154(b) by 111 days.

(21) Appl. No.: 15/639,537

(22) Filed: Jun. 30, 2017

Related U.S. Application Data

(63) Continuation of application No. 15/063,884, filed on Mar. 8, 2016, now abandoned.

(51) Int. Cl.

| | |
|---|---|
| ***B05B 5/03*** | (2006.01) |
| ***B05B 5/00*** | (2006.01) |
| ***B05B 5/053*** | (2006.01) |
| ***B05B 5/16*** | (2006.01) |
| ***B05B 12/00*** | (2018.01) |

(52) U.S. Cl.
CPC ..... *B05B 5/004* (2013.01); *B05B 5/03* (2013.01); *B05B 5/0533* (2013.01); *B05B 5/1691* (2013.01); *B05B 12/002* (2013.01)

(58) Field of Classification Search
CPC ..... B05B 5/004; B05B 5/03; B05B 5/033; B05B 5/1691; B05B 12/002; B05B 14/41; B05B 14/42; B05B 14/412
See application file for complete search history.

(56) References Cited

U.S. PATENT DOCUMENTS

| | | | | |
|---|---|---|---|---|
| 2,357,354 A | | 9/1944 | Penney | |
| 4,004,733 A | * | 1/1977 | Law | B05B 5/043 239/3 |
| 4,273,293 A | | 6/1981 | Hastings | |
| 4,509,694 A | | 4/1985 | Inculet et al. | |

(Continued)

OTHER PUBLICATIONS

Inculet, et al., "Electrostatic Charging and Dissipation of Dust Clouds in Enclosed Rooms" IEEE Transactions on Industry and General Applications, Mar./Apr. 1971, pp. 314-314, vol. IGA-7, No. 2, IEEE, US.

(Continued)

*Primary Examiner* — Tuongminh N Pham
(74) *Attorney, Agent, or Firm* — Mitch Harris, Atty at Law, LLC; Andrew M. Harris

(57) ABSTRACT

An electrostatic sprayer system for dispensing and dispersing a liquid containing a spray compound includes a spray cloud dispersal feature that reduces the time that a residual spray cloud containing droplets including the spray compound remains suspended after spraying. A method of dispersing the residual spray cloud is implemented by a control system that causes a flow control system to deliver a non-active gas or liquid in conjunction with stopping delivery of the liquid containing the spray agent and charged with the same polarity, so that a charged cloud of the non-active gas or liquid, which may be air, displaces the suspended active fluid particles. The non-active gas or liquid may be dispensed for a predetermined time interval as determined by the control system, or the operator may control the time interval during which that the non-active fluid is dispensed.

12 Claims, 8 Drawing Sheets

(56) References Cited

U.S. PATENT DOCUMENTS

| | | | | |
|---|---|---|---|---|
| 4,666,089 | A | 5/1987 | Inculet | |
| 4,685,620 | A | 8/1987 | Law et al. | |
| 8,241,562 | B1 | 8/2012 | Betty et al. | |
| 2009/0110803 | A1* | 4/2009 | Mather | B05B 15/55 427/8 |
| 2011/0137268 | A1* | 6/2011 | Thomason | B05B 7/066 604/291 |

OTHER PUBLICATIONS

Melcher, et al., "Charged Droplet Technology for Removal of Particulates from Industrial Gases", Continuum Electromechanics Group, Department of Electrical Engineering, Massachusetts Institute of Technology, Aug. 1, 1971, 124 pages (pp. 1-124 in pdf), US.

Almuhanna, "Dust Control in Livestock Buildings with Electrostatically-Charged Water Spray", Department of Biological and Agricultural Engineering, College of Engineering, Kansas State University, 2007, 236 pages (pp. 1-236 in pdf), US.

* cited by examiner

ELECTROSTATIC FLUID SPRAYER WITH ACTIVE FLUID CLOUD DISPERSAL FEATURE AND METHOD OF ELECTROSTATIC SPRAYING

This U.S. Patent Application is a Continuation of U.S. patent application Ser. No. 15/063,884 filed on Mar. 8, 2016, and claims priority thereto under 35 U.S.C. § 120.

BACKGROUND OF THE INVENTION

1. Field of the Invention

The present invention relates to electrostatic liquid sprayer systems, and in particular an electrostatic sprayer having an active fluid cloud dispersal feature.

2. Background of the Invention

An air-assisted induction-charging electrostatic spraying process produces a charged spray of atomized liquid droplets containing a spray agent delivered in an air stream. Advantages of electrostatic spraying are more uniform spray cloud dispersion into a space, as well as improved deposition uniformity and efficiency of deposition onto complex three-dimensional surfaces to be coated. Electrostatic spraying often allows a lower volume of liquid to be used to coat surfaces than would be required by uncharged conventional hydraulic spraying. The improved efficiency permits surfaces such as fabric or paper products to be sprayed without significant wetting of the materials. Many types of target surfaces are currently coated using electrostatic sprays. Applications vary from agricultural crop spraying to application of paint or other coatings to automobiles, appliances, furniture and many other manufactured goods. Unique opportunities for electrostatic spraying are still emerging. For example, recently developed applications involve coating of surfaces with sanitizing agents for odor control and the prevention of illness caused by virus and bacteria in areas of high human concentration such as hotels, hospitals, restaurants, schools, day care services, military installations and cruise ships.

In electrostatic spraying, the electrical force causing the charged droplets to move toward the targets depends on the magnitude of the space charge of the emitted spray cloud. When electrostatically spraying a target or a room space with a charged liquid spray, the force at which the liquid spray is directed to the target diminishes as the spray cloud expands. The result is that a significant amount of the charged spray remains suspended in the room air for extended periods of time once most of the spray has be deposited on the target surfaces. Charged spray droplets may also lose their charge when the intense electric field they produce causes air to become ionized at sharp points or edges on targets, or by brief contact with surfaces in which their charge is transferred, but the droplets do not adhere to the surfaces. Small uncharged droplets may also remain suspended and may drift to areas for which spraying is not intended. In some applications, the suspended particles may delay use of the location, since the particles might be aspirated by room occupants. In the case of hazardous fluids such as pesticides and some cleaning agents, the location may have to remain unused for a long period of time for the fluid particles to settle. In open or partially-open locations, suspension of a cloud may result in a loss of some of the active fluid agent, since wind currents can interfere with the settling process.

Therefore, it would be desirable to provide an electrostatic sprayer system and method that reduces the amount of and/or time of active fluid particle suspension after spraying is complete.

SUMMARY OF THE INVENTION

The above objectives, as well as others, are accomplished in a method of electrostatic spraying as well as an electrostatic sprayer system.

The method comprises spraying an active liquid including a spray compound (active agent) by atomizing the active liquid and charging the atomized liquid with a single polarity to form a charged active agent spray having a single charge polarity. In conjunction with de-selecting spraying of the charged spray, which may be before or after the spraying of the active liquid ceases, a non-active agent, which may be a gas such as air or a non-active liquid, is also charged with the single polarity and emitted into the room to cause a residual spray cloud containing the active agent to disperse. If a non-active liquid is used, the non-active liquid is also atomized, charged with the single polarity and ejected to form a charged non-active spray.

The sprayer system includes a sprayer having a nozzle for charging, atomizing and spraying the active liquid containing the spray compound, and subsequently charging and spraying air or the non-active liquid, including atomizing non-active liquid if used. As an alternative, a base unit of the system may include a unit for charging and dispensing the non-active liquid or air. In one example, the electrostatic sprayer system includes a sprayer head having a sprayer outlet for dispensing a liquid containing the active agent that has been charged via an electrode of the sprayer head, an air compressor for supplying pressurized air to the sprayer head to form an air sheath between the nozzle and the electrode to eject the charged active agent liquid from the sprayer outlet, a vessel containing the active agent liquid prior to dispensing, a power supply for providing a voltage and a current to the electrode, a flow controller for controlling delivery of the active agent liquid to a liquid outlet of the sprayer head, and a control system for controlling the flow controller so that the active agent liquid is sprayed for a first time interval, and charged air or a second atomized and charged non-active liquid is sprayed for a second time interval to disperse the spray cloud containing the active agent. The first and second time intervals can be sequential, or there may be a period of overlap.

The foregoing and other objectives, features, and advantages of the invention will be apparent from the following, more particular, description of the preferred embodiment of the invention, as illustrated in the accompanying drawings.

BRIEF DESCRIPTION OF THE DRAWINGS

The novel features believed characteristic of the invention are set forth in the appended claims. The invention itself, however, as well as a preferred mode of use, further objectives, and advantages thereof, will best be understood by reference to the following detailed description of the invention when read in conjunction with the accompanying Figures, wherein like reference numerals indicate like components, and:

DESCRIPTION OF ILLUSTRATIVE EMBODIMENT

The present invention concerns a method of electrostatic spraying and an electrostatic sprayer that reduces the amount of residual spray cloud containing the spray compound, i.e., the active agent, in a space. The method comprises electrostatically spraying a liquid containing the active agent in the space by atomizing the liquid and charging the atomized liquid with a single polarity and then spraying a air or non-active liquid droplets charged with the single polarity to force the spray cloud to continue to expand and/or to dissipate a spray cloud that has stopped expanding. The spraying of the air or non-active liquid droplets can be commenced before stopping the spraying of the active liquid, or may be commenced in response to stopping the spraying of the active agent.

Figure 1:
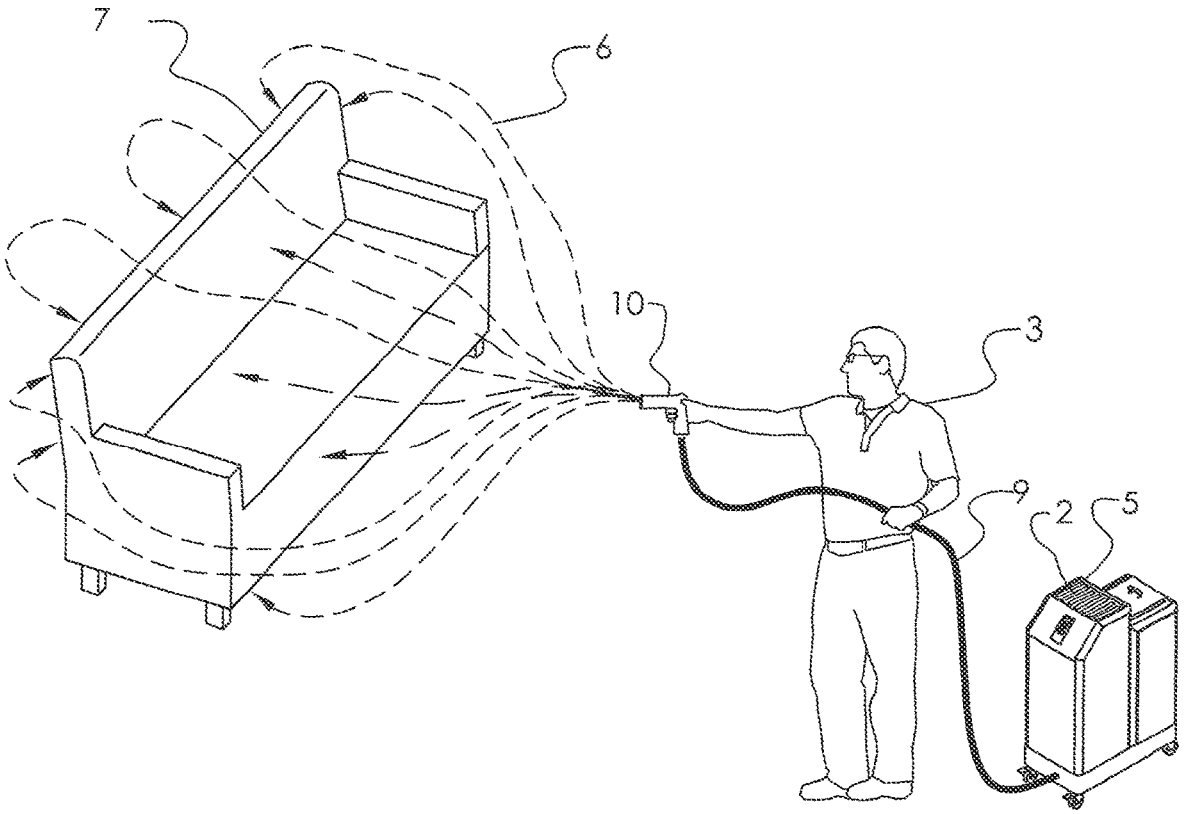
FIG. 1 is a pictorial diagram depicting operation of an exemplary electrostatic sprayer system.

Referring now to FIG. 1, an electrostatic sprayer system and method for disinfecting items in a room are illustrated. A sprayer head 10 that dispenses an electrostatically charged disinfecting spray cloud is directed at a target, such as sofa 7, by a user 3. Sprayer head 10 is an electrostatic sprayer head in accordance with an embodiment of the invention as illustrated in further detail below. A base unit 5 provides a source of active liquid forming or containing the spray compound, although the active liquid may be contained in a reservoir attached to or contained within sprayer head 10. A non-active liquid may also be stored in base unit 5 or sprayer head 10. Base unit 5 also supplies air pressure via a hose connection 9, and optionally provides a source of power, although a battery within sprayer head 10 may be included to provide power. While base unit 5 is depicted as a rolling movable chassis, alternatively base unit 5 may be a backpack worn by user 3, or a stationary unit into which sprayer head 10 is connected. The spray ejected from the tip of sprayer head 10 coats surfaces more uniformly and generates a spray cloud pattern that can reach hidden surfaces underneath and behind sofa 7 providing more effective disinfection than would be possible with ordinary sprays and without moving and upending sofa 7. Sprayer head 10 is generally dispensing a low-volume spray of liquid at a flow rate of less than 300 ml per minute and preferably less than 150 ml per minute to prevent significant wetting of sensitive targets such as the fabric of sofa 7 or other items in the room such as paper items. The spray compound being applied by user 3 may be a disinfectant, a pesticide or some form of cleaner, all of which may require that the room containing sofa 7 remain vacant for a predetermined period of time so that the aerosol spray cloud generated by sprayer head 10 has time to settle, so that people occupying the room do not breathe the active agent. In order to reduce the amount of time that the room must remain unoccupied, and in some instances to further improve the coating of surfaces by the spray cloud, the exemplary systems and methods disclosed herein spray or dispense a non-active charged gas (e.g., compressed air) or liquid spray to cause the standing aerosol cloud containing the active spray compound to dissipate. Base unit may include an air ionizer 2 specially adapted for emitting ionized air for a time after spraying of the liquid containing the spray compound has ceased. Air ionizer is calibrated to emit the proper amount of charge to disperse the spray cloud generated by sprayer head 10 and emits ions with a single electrical polarity to cause the charged spray emitted by sprayer head 10 to disperse efficiently. Other techniques include spraying a charged non-active liquid or ionized air using sprayer head 10 or another sprayer, as will be discussed in further detail below.

Figure 2:
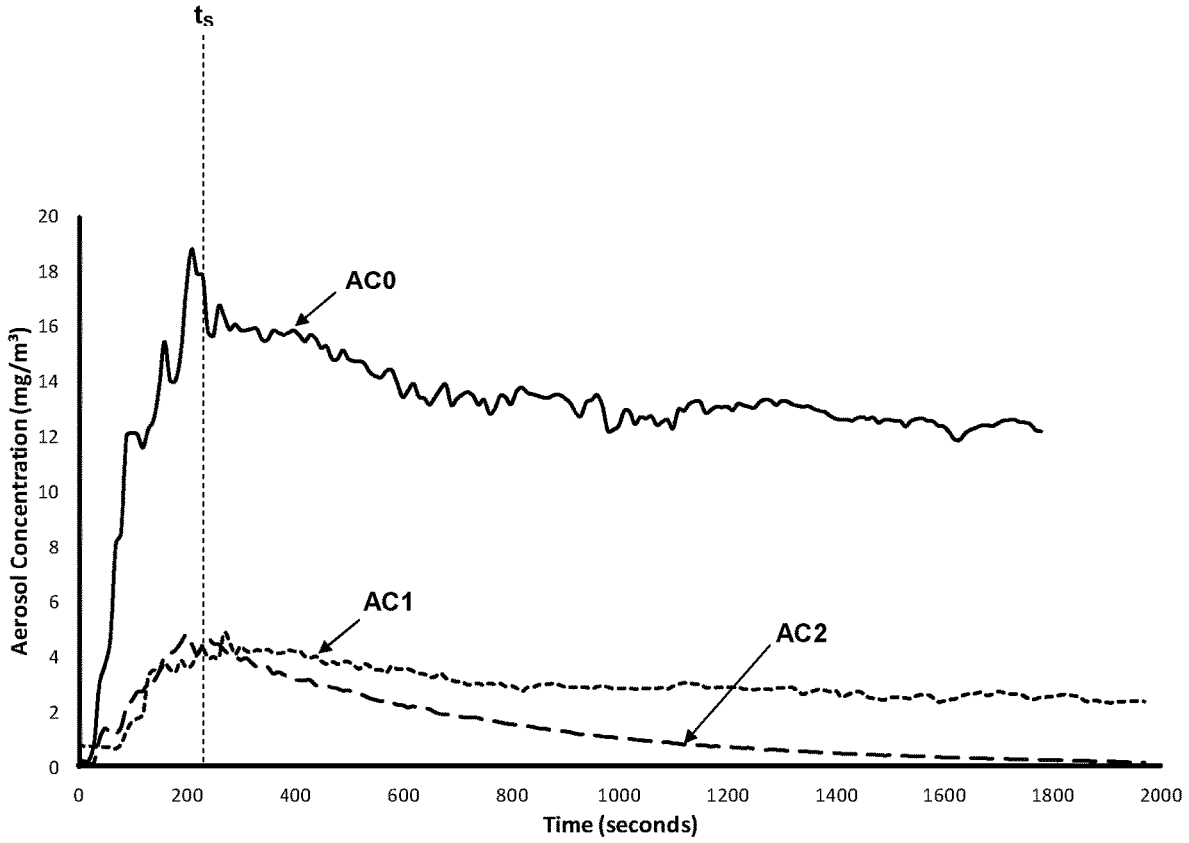
FIG. 2 is a graph depicting performance of an exemplary electrostatic sprayer system.

Referring now to FIG. 2, operation of a sprayer system without the improvements disclosed herein vs. a sprayer system including such improvements is shown in a graph of aerosol concentration over time. Between time 0 and sprayer stop time $t_S$, sprayer head 10 is operated to spray the liquid containing the spray compound. Curve AC1 shows the aerosol concentration increasing as sprayer head 10 sprays the liquid, and after time $t_S$, the lingering residual aerosol remains suspended at more than 50% of its maximum concentration at 30 minutes after spraying has ceased. Curve AC0 shows the aerosol concentration using a non-electrostatic spray technique, illustrating that while electrostatic spraying reduces the amount of residual aerosol, both non-electrostatic and electrostatic spraying techniques leave significant amounts of the spray compound in aerosol form long after spraying has ceased. Curve AC2 shows performance of an electrostatic spraying method as disclosed herein, either using an electrostatic sprayer that sprays a charged non-active liquid or gas or using a separate electrostatic sprayer or ionizer after time $t_S$. After 20 minutes, the concentration of the residual aerosol has dropped to approximately 10% of the peak concentration and after 30 minutes, less than 5% of the original aerosol remains.

Figure 3:
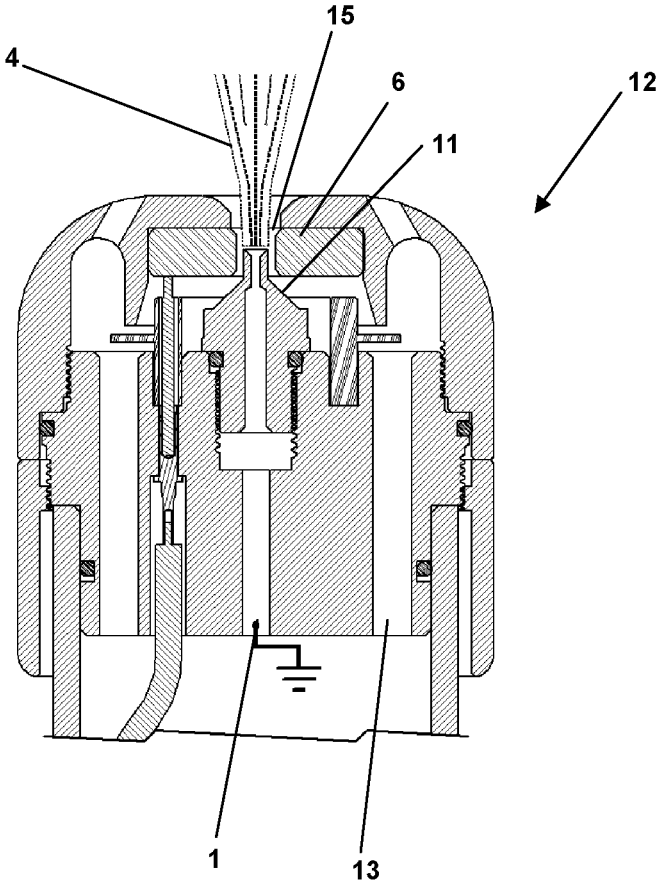
FIG. 3 is a cross-section of an electrostatic spray nozzle assembly that may be used within electrostatic spray head 10 of FIG. 1.

Referring now to FIG. 3, details of a nozzle assembly 12 of sprayer head 10 are shown. Nozzle assembly 12 includes a liquid tip 11 that ejects the liquid and an electrode 6 having a voltage of a single polarity that charges a spray 4 formed by droplets of the liquid, as described above. Air or other pressurized gas is provided to nozzle assembly 12 and passes though a gas channel 13 to form an air sheath 15 that surrounds the fluid ejected from liquid tip 11. Liquid enters nozzle assembly 12 through a separate liquid channel 1. The liquid may be connected to earth or a reference potential differing from that of electrode 6 at some location within nozzle assembly 12 or at any point upstream of nozzle assembly 12 including the liquid source, such as a tank within base unit 5 of FIG. 1. Liquid is ejected from liquid tip 11 where the liquid is atomized by the high velocity gas, usually air, flowing around liquid tip 11 and through electrode 6. The collimated spray, which is a stream of atomized liquid droplets, exits as charged spray 4. Further details of an example of a nozzle suitable for use in the system disclosed herein are given in U.S. Pat. No. 9,138,760 entitled "ELECTROSTATIC LIQUID SPRAY NOZZLE HAVING AN INTERNAL DIELECTRIC SHROUD", the disclosure of which is incorporated herein by reference. If only air is supplied through gas channel 13 with no liquid supplied through liquid tip 11, then ionized air can be supplied subsequent to, or for a predetermined interval before, ceasing the flow of the liquid containing the active spray agent, or the air may be ionized within nozzle assembly 12. Wherever the air or atomized droplets are ionized, they are charged to the same polarity as the active spray to supplement the electrical field produced by the spray. In some instances, such as spraying in the vicinity of very non-conductive targets, it is important to provide the facility to cease dispensing of the non-active spray (whether air or non-active liquid) during spraying of the active agent to prevent excess buildup of charge on target surfaces. When a non-active fluid is to be sprayed, provisions for storing and delivering the non-active fluid to either liquid tip 11 or another liquid tip must be provided. Particular arrangements of sprayer head elements for performing non-active liquid or ionized air delivery are described below with reference to FIGS. 4A-4D.

The exemplary configurations shown below with reference to FIGS. 4A-4D and FIGS. 5-6 are intended to show various components that support various features of electrostatic spray systems as disclosed herein and should not be considered limiting as to the location or inclusion of the various components, as some electrostatic sprayer systems that incorporate the features disclosed herein may not have a separate base unit and sprayer head. Multiple sprayer head configurations may be connected to a single base unit or separate base units for spraying the active liquid and the non-active liquid or ionized air, respectively.

Figure 4A:
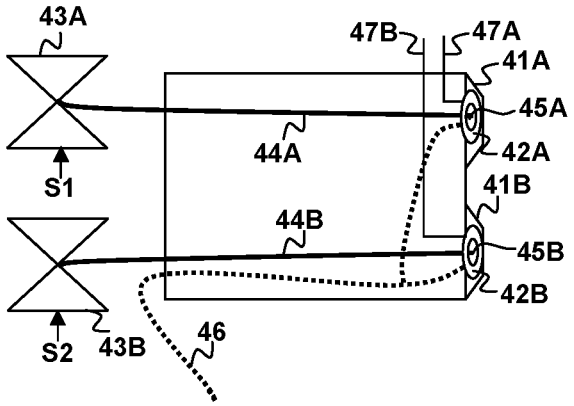
FIGS. 4A-4D are schematics of various electrostatic spray outlet configurations that may be used within electrostatic spray head 10 of FIG. 1.

Referring now to FIG. 4A, an exemplary implementation for sprayer head 10 is shown, in which two separate spray outlets 41A,41B are provided for spraying an active liquid, i.e., a liquid containing or forming a spray agent and a non-active liquid, e.g., water, respectively. Compressed air is supplied through a distribution system 46, which may be provided by channels in the body of sprayer head 10 as shown above. Each of spray outlets 41A,41B has a separate electrode 42A,42B which may have different configurations, and will generally be supplied with a different voltage and current, depending on the type of active and non-active liquid being sprayed. Power supply connections 47A, 47B separately couples electrodes 42A,42B to one or more power supplies. Separate power supplies may be advantageous, depending on the differences between the voltages and currents required for charging droplets of the different liquids and the flow rate of the compressed air used to eject the liquid droplets. In the embodiment depicted in FIG. 4A a pair of valves 43A,43B are responsive to control signals S1 and S2 to select delivery of the active liquid or the non-active liquid, or in some cases overlapping simultaneous delivery of the liquids, in order to alternate between applying the active spray compound and dispersing the residual active spray cloud by electrostatically spraying the non-active liquid. In all of the embodiments shown herein, valves 43A,43B can be replaced by pumps, or by selective application of air pressure to tanks containing the corresponding liquids. Valves 43A,43B are illustrated to show selection and de-selection of delivery of particular active and non-active liquids. A pair of tubes 44A,44B deliver the different liquids from valves 43A,43B to their respective liquid tips 45A, 45B. Tubes 44A,44B may be replaced in part or completely via channels within sprayer head 10.

Figure 4B:
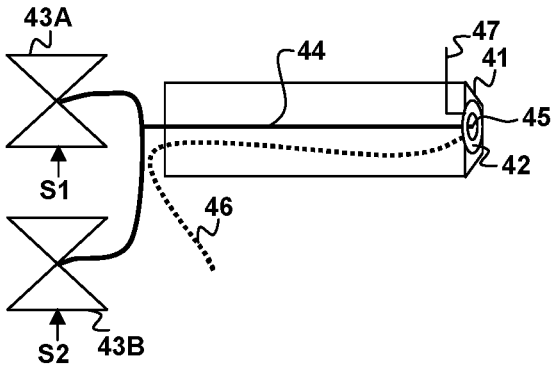

Referring now to FIG. 4B, another exemplary implementation for sprayer head 10 is shown, in which a single spray outlet 41 is provided for spraying an active liquid and a non-active liquid. Spray outlet 41 has an electrode 42 that may be supplied with a different voltage and current from a power supply connection 47, depending on whether spraying of the active liquid, the non-active liquid, or both is selected. The liquids are delivered through a tube 44 to a liquid tip 45. Other features of the implementation depicted in FIG. 4B are the same as the implementation shown in FIG. 4A, so only differences between them are described above.

Figure 4C:
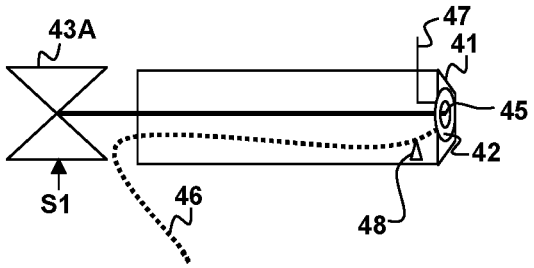

Referring now to FIG. 4C, another exemplary implementation for sprayer head 10 is shown, in which a single spray outlet 41 is provided for spraying the active liquid and ionized air as the non-active spray. The features of the implementation depicted in FIG. 4C are similar to those of FIG. 4B, so only differences are described below. The air can either be ionized in base unit 5 or somewhere along distribution system 46 such as an electrode 48 positioned near spray outlet 41 and only single valve 43A is used to select or de-select the flow of liquid to liquid tip 45. The ionization of the air may be de-selected when spraying liquid from sprayer outlet 41.

Figure 4D:
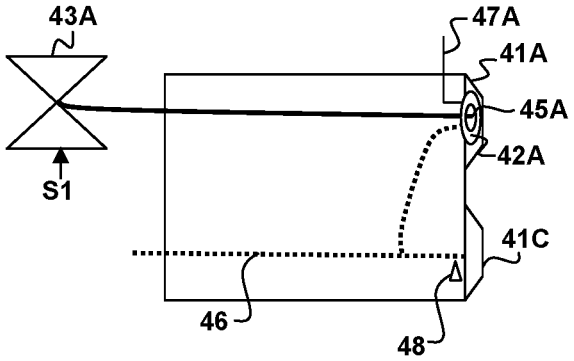

Referring now to FIG. 4D, another exemplary implementation for sprayer head 10 is shown, in which spray outlet 41A is provided for spraying the active liquid and a separate spray outlet 41C is provided for spraying ionized air as the non-active spray. The features of the implementation depicted in FIG. 4D are similar to those of FIG. 4A and FIG. 4C, so only differences are described below. As in the embodiment of FIG. 4C, air can be ionized in base unit 5 or somewhere along distribution system 46, and the ionization may be deactivated when the spraying of the active liquid is selected. If electrode 48 is provided proximate spray outlet 42C, then ionized air can be sprayed while delivery of liquid to liquid tip 45A is still selected.

Figure 5:
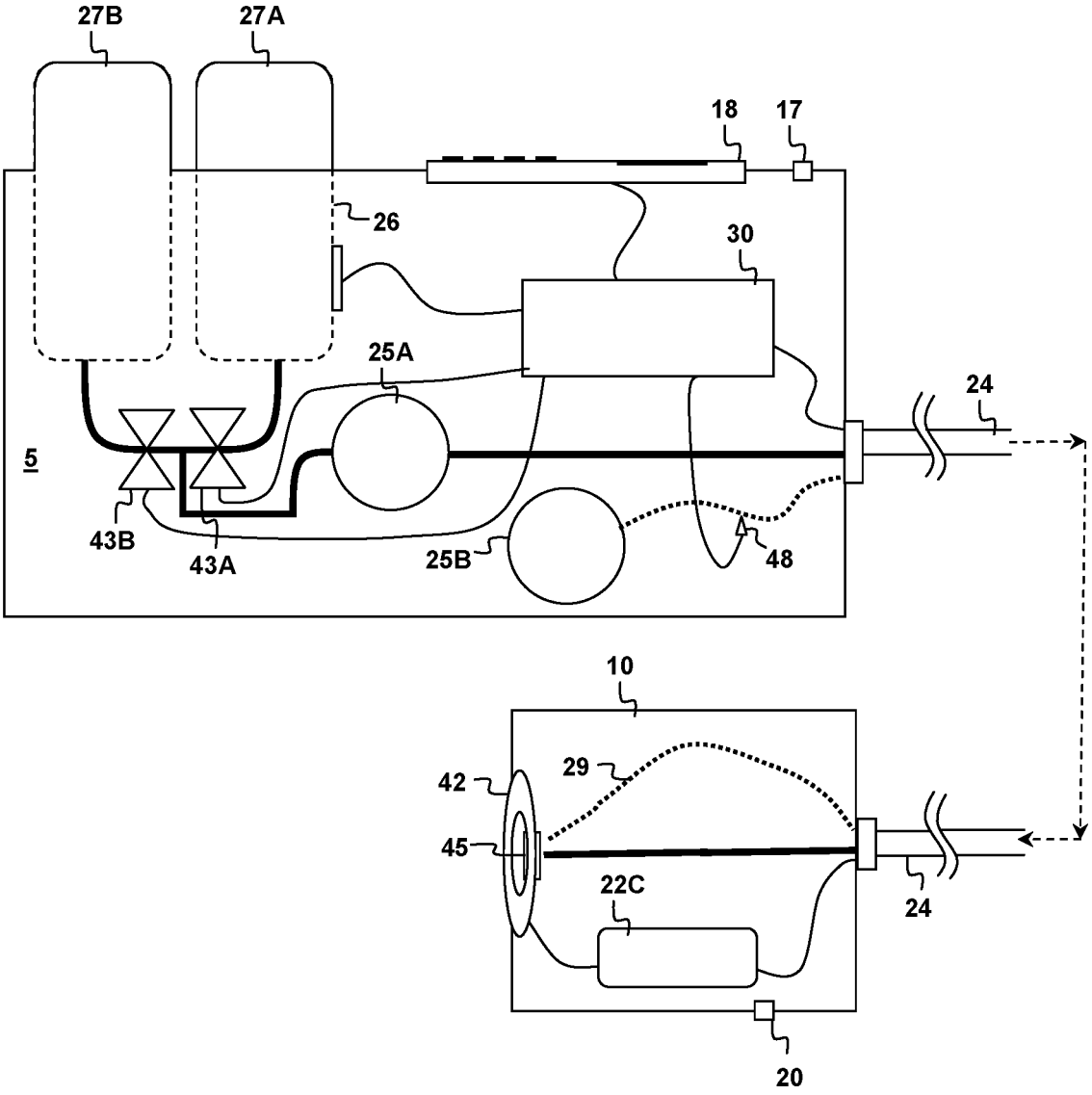
FIG. 5 is a pictorial diagram showing internal details of components within an exemplary electrostatic sprayer system.

Referring now to FIG. 5, exemplary internal features of base unit 5 and sprayer head 10 are shown. The exemplary configuration is intended to show various components that support various features of electrostatic spray systems as disclosed herein and should not be considered limiting as to the location or inclusion of the various components, as some electrostatic sprayer systems that incorporate the features disclosed herein may not have a separate sprayer head and some sprayer head configurations may not be connected to a separate base unit. Within base unit 5, a removable liquid cartridge 27A, which contains a particular type of liquid containing or forming an active spray compound to be dispensed as an electrostatically charged spray, is inserted in a recess 26 of the housing of base unit 5. Alternatively, the liquid forming or containing the spray compound may be poured into a fixed tank located on sprayer head 10 or in base unit 5. Base unit 5 optionally includes another liquid tank or cartridge 27B, generally for water or some other inert liquid, that is used to provide a non-active liquid for spraying at the end of, or after spraying of the liquid containing the spray compound. As described above, valve 43A, and optionally valve 43B, provide for control of the flow of the liquid from cartridge 27A and tank or cartridge 27B, so that flow of the active liquid to sprayer head 10 can be de-selected (ceased) and either flow of the non-active liquid from tank or cartridge 27B, or no liquid flow at all can be selected to select spraying of the non-active liquid or ionized air if a non-active liquid media is not to be sprayed to disperse the residual active spray cloud.

Base unit 5 further includes a liquid pump 25A, air compressor 25B, control panel 18, key or card reader 17 and a control unit 30 that controls operation of the electrostatic sprayer system. A cable 24 that includes a tube conducting the liquid media pumped from removable cartridge 27A (and optionally 27B) by pump 25A, a hose 29 providing compressed air around liquid tip 45, and electronic wiring between control unit 30 and sprayer head 10, such as inputs for a high-voltage electrode power supply 22C that supplies the electrostatic potential to an electrode 21 surrounding a nozzle tip 21 of sprayer head 10, as well as control signals from controls of sprayer 10 such as on/off or trigger pressure indications from a trigger switch 20 that controls spraying and optionally including a second trigger or a second trigger position that controls application of the non-active liquid or ionized air.

Figure 6:
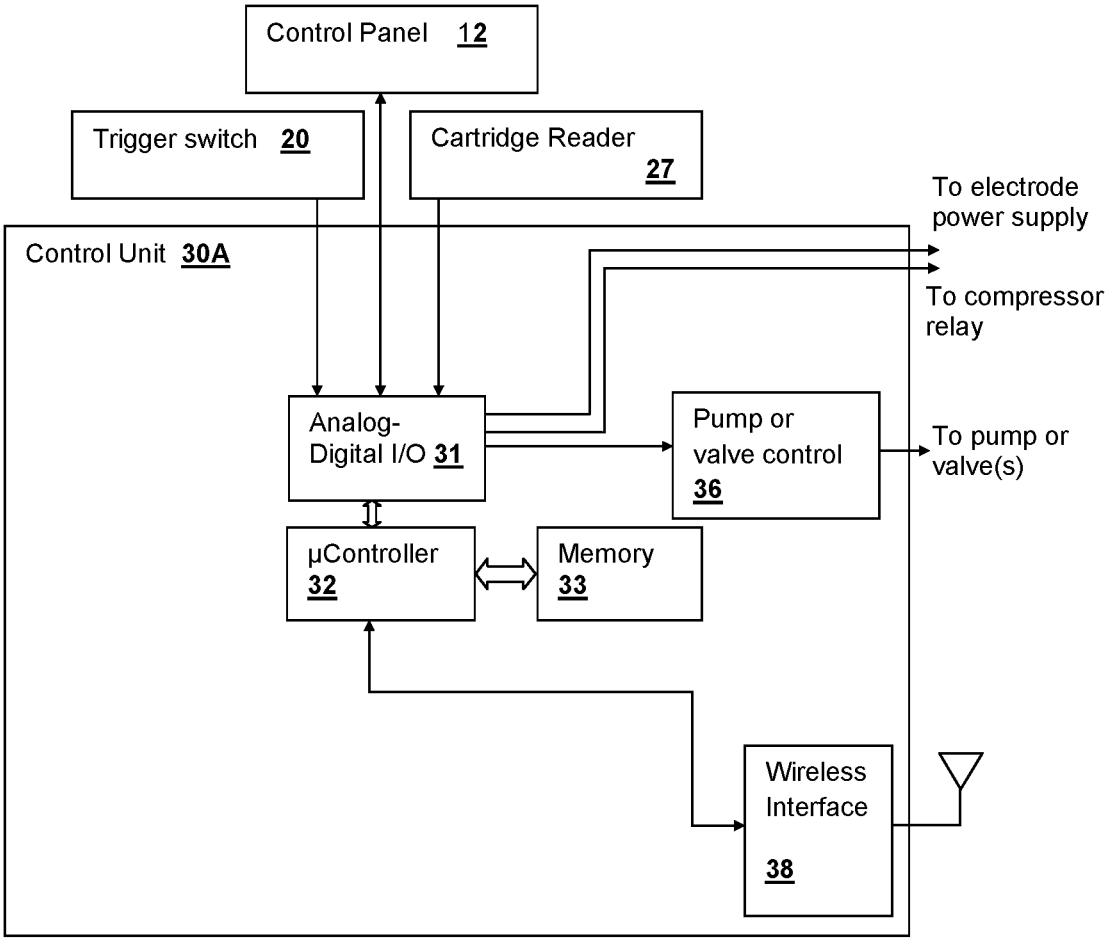
FIG. 6 is an electronic block diagram of the exemplary electrostatic sprayer system of FIG. 3.

Referring now to FIG. 6, details of a control unit 30A for the example electrostatic sprayer are shown. A microcontroller 32 receives inputs and controls operation of the electrostatic sprayer via a program, i.e., a computer program product, stored in a memory 33, which also stores data. An analog/digital I/O unit 31 receives signals from internal circuits of the electrostatic sprayer and generates control output signals according to the program contained in memory 33, which forms a computer program product having unique features as described herein. Communications may be sent to, and control input received from, a remote computer system via a wireless interface 38. Wireless interface 38 may be a 802.11 "wifi" interface, a Bluetooth Interface, a Near-Field interface, an audio link or an optical link such as an infrared (IR) link. Wireless interface 38 may link directly with the remote computer, or may interact with an application or systems' function on a wireless device, such as a tablet or mobile telephone used by the user in conjunction with the electrostatic sprayer to perform control functions. For example, wireless interface 38 may be a Bluetooth® interface that communicates with an application executing within a mobile telephone of the user to control the sprayer.

Microcontroller 32 is also interfaced to control panel 18 to provide functions as described herein. Analog-Digital I/O 31 further provides signals to a pump motor or valve control 36 and/or air compressor relay. Analog-Digital I/O 31 also provides input power for electrode power supply 22C which generally will be located close to electrode 21. Analog-Digital I/O 31 includes analog-to-digital converters (ADCs) and digital-to-analog converters (DACs) as required to convert analog signals to digital information and vice-versa. Analog-Digital I/O 31 may be provided by converters integrated within microcontroller 32. Analog-Digital I/O 31 receives a feedback signal from electrode power supply 22C indicating the current drawn by electrode 21, which informs microcontroller 32 of the level of the current. As noted above, the voltage and current level generally need to be controlled at different levels for the spraying of the active agent and any spraying of a non-active liquid.

Figure 7:
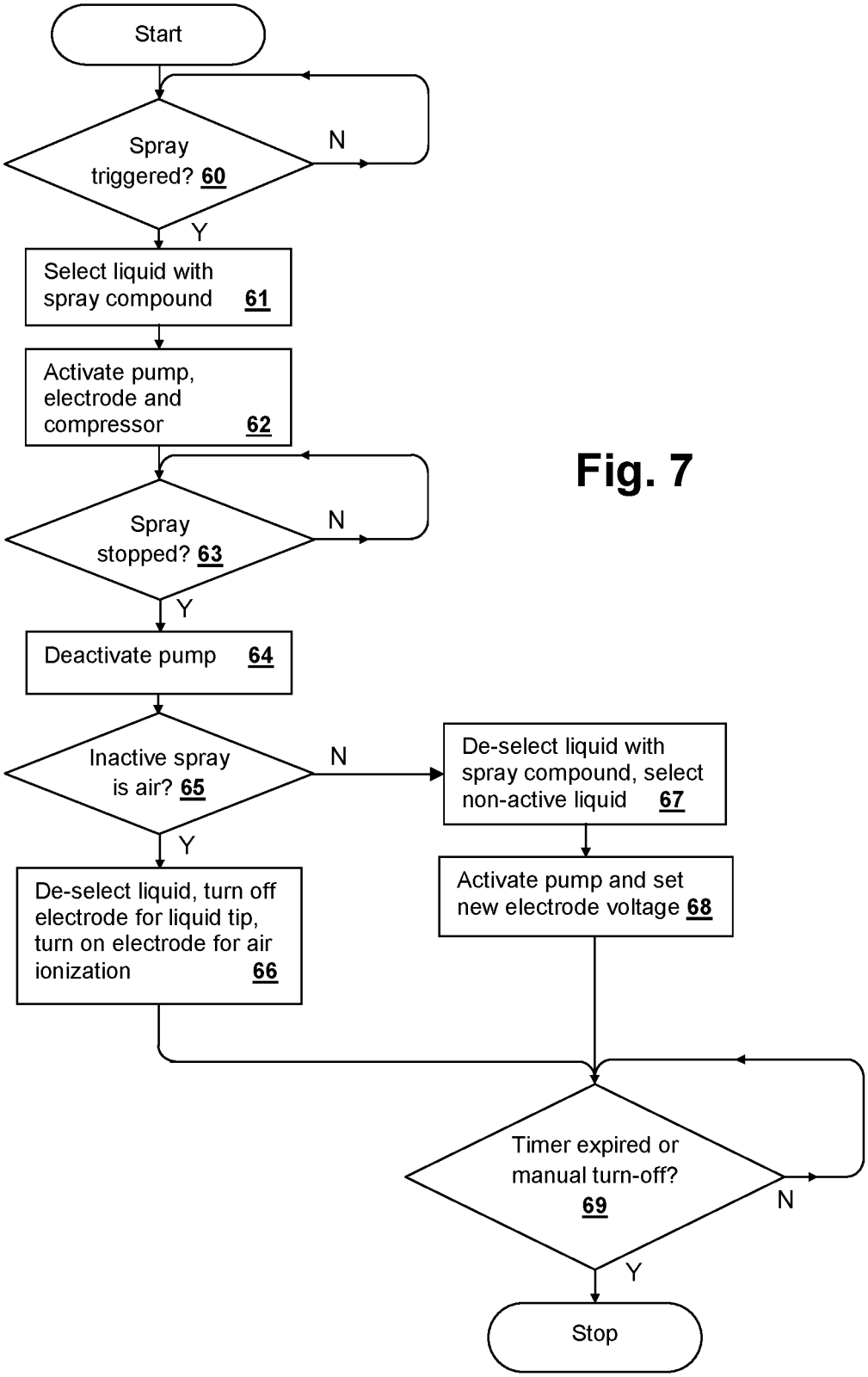
FIG. 7 is a flow chart illustrating an example of an exemplary method of electrostatic spraying.

Referring now to FIG. 7, a method according to an example of operation of the electrostatic sprayer system is illustrated in a flowchart. When spraying is triggered/activated (decision 60), the liquid containing the active agent is selected for spraying (step 61) and the valve (or pump) that controls the flow of the active liquid and the electrode that charges the liquid spray are activated (step 62). When spraying of the active liquid is stopped (decision 63) (or alternatively a selection is made to disperse the residual spray cloud), the valve or pump activated in step 62 is de-activated (step 64). If the non-active spray is to be ionized air (decision 65), then the active liquid is de-selected, the liquid tip electrode is turned off, and the electrode for air ionization is activated (step 66). If a non-active liquid is used to disperse the spray cloud, then the non-active liquid is selected (step 67) the pump is activated and a new electrode voltage is set for spraying the non-active liquid (step 68). Until a timer expires or the spraying of the inactive liquid or ionized air is turned-off by manual command (decision 69), spraying of the inactive liquid or ionized air continues. As mentioned above, steps 67 and 68 can be commenced before stopping the spraying of the active agent in some embodiments that support overlapped spraying of the active liquid and the inactive liquid or ionized air, in which case step 64 and the de-selection of active liquid will be performed later after a predetermined interval.

While the invention has been particularly shown and described with reference to the preferred embodiments thereof, it will be understood by those skilled in the art that the foregoing and other changes in form, and details may be made therein without departing from the spirit and scope of the invention.

What is claimed is:

1. A method of electrostatically spraying a spray compound in a room with a sprayer system, the method comprising:

directing charged active liquid containing a spray agent from a sprayer head of the sprayer system, the sprayer head for dispensing the charged active liquid to target surfaces within the room, wherein the sprayer head includes a first liquid outlet for emitting the active liquid, a first vessel coupled to the first liquid outlet for storing the active liquid, and an a first electrode adjacent to the first liquid outlet for charging the active liquid;

controlling a flow of the active liquid to the first liquid outlet of the sprayer head with a flow controller of the sprayer system; supplying a current and a voltage having a single polarity to the first electrode;

supplying pressurized air to the sprayer head from an air compressor of the sprayer system to form an air sheath between the first liquid outlet and the first electrode to eject the charged active liquid from the first liquid outlet to form an active agent spray, wherein the active agent spray forms a spray cloud that expands to coat surfaces and leaves a residual active agent spray cloud suspended in the room;

stopping the dispensing of the charged active liquid by the flow controller stopping the flow of the active liquid; and in conjunction with stopping the dispensing of the charged active liquid, charging non-active liquid droplets with a second electrode providing the single polarity from the sprayer system and introducing the non-active liquid droplets into the room by ejecting the charged non-active liquid from a second liquid outlet adjacent to the second electrode with the pressurized air to generate a supplemental electric field to disperse the residual active agent spray cloud.

2. The method of claim 1, wherein the charging the non-active liquid droplets and introducing the non-active liquid droplets into the room is performed in response to the stopping of the dispensing of the charged active liquid.

3. The method of claim 1, wherein the introducing the non-active liquid droplets into the room is performed for a predetermined time interval with respect to a time of the stopping of the dispensing of the charged active liquid.

4. The method of claim 1, wherein the charging the non-active liquid droplets and introducing the non-active liquid droplets into the room is commenced prior to the stopping of the dispensing of the charged active liquid and subsequent to the active agent spray forming the spray cloud.

5. The method of claim 1, wherein the introducing sprays the charged non-active liquid in the room.

6. The method of claim 5, wherein the introducing comprises charging the pressurized air supplied to the sprayer head responsive to stopping the dispensing of the charged liquid.

7. The method of claim 1, wherein the second liquid outlet is included in the sprayer head.

8. An electrostatic sprayer system, comprising: a sprayer head for dispensing a charged active liquid containing an active spray compound, wherein the sprayer head includes a first liquid outlet for emitting the active liquid and aft first electrode adjacent to the first liquid outlet for charging the active liquid;

an air compressor for supplying pressurized air to the sprayer head to form an air sheath between the first liquid outlet and the first electrode to eject the charged active liquid from the first liquid outlet;

a first vessel containing the active liquid prior to dispensing;

a second liquid outlet;

a second electrode adjacent to the second liquid outlet;

a second vessel containing the non-active liquid;

a power supply for providing a current and a voltage of a single polarity to the first electrode;

a flow controller for controlling a flow of the active liquid to the first liquid outlet of the sprayer head; and a control system for controlling the flow controller such that the active liquid is delivered to the first liquid outlet while spraying of the active liquid is selected, wherein the control system signals the flow controller to de-select spraying of the active liquid, and wherein the electrostatic sprayer system is further configured to emit charged droplets of the non-active liquid that is charged with the single polarity in conjunction with the flow controller de-selecting spraying of the active liquid, wherein the flow controller selects between delivering the active liquid from the first vessel to the first liquid outlet and delivering the non-active liquid from the second fluid vessel to the second liquid outlet, wherein the power supply supplies another voltage and another current to the second electrode to charge the charged droplets of non-active liquid, and wherein the aft compressor further supplies the pressurized aft to eject the charged droplets of non-active liquid.

9. The electrostatic sprayer system of claim 8, wherein the control system first de-selects spraying of the active liquid and responsive to having de-selected spraying of the active liquid, selects spraying of the charged droplets of non-active liquid.

10. The electrostatic sprayer system of claim 9, wherein the control system selects spraying of the charged droplets of non-active liquid prior to de-selecting spraying of the active liquid.

11. The electrostatic sprayer system of claim 10, wherein the control system is responsive to manual controls to permit selection and de-selection of spraying of the active liquid and selection and de-selection of spraying of the charged droplets of non-active liquid.

12. The electrostatic sprayer system of claim 8, wherein the second liquid outlet and the second electrode are included in the sprayer head.

* * * * *